United States Patent [19]

Johnson

[11] 4,248,660

[45] Feb. 3, 1981

[54] LABEL REMOVAL DEVICE

[76] Inventor: Herbert E. Johnson, 1023 Phelps Ave., San Jose, Calif. 95117

[21] Appl. No.: 43,284

[22] Filed: May 29, 1979

[51] Int. Cl.[3] ..... A47L 13/08; B26B 3/00

[52] U.S. Cl. ..... 156/579; 15/236 R; 30/169; 30/357; 156/584

[58] Field of Search ..... 156/584, 344, 579; 15/236 R; 30/169, 346, 357, DIG. 3, 346.55

[56] References Cited

U.S. PATENT DOCUMENTS

| | | | |
|---|---|---|---|
| 1,242,479 | 10/1917 | Russell | 156/584 |
| 2,188,114 | 1/1940 | Hubbard | 15/236 R |
| 3,040,802 | 6/1962 | Frazer | 156/584 |
| 3,092,411 | 6/1963 | Hardy | 30/169 X |
| 3,818,592 | 6/1974 | Himeno | 30/169 X |
| 4,128,452 | 12/1978 | Johnson et al. | 156/584 |

*Primary Examiner*—Michael G. Wityshyn

*Attorney, Agent, or Firm*—Townsend and Townsend

[57] ABSTRACT

A device for removing self-adhesive labels from a substrate includes a blade portion and a handle portion. The blade has a first normally downwardly facing flat surface for contacting the substrate and a second opposed normally upwardly facing generally convex surface. The first and second surfaces come together along a generally curved periphery at a small angle to define a sharp edge. The blade and handle are preferably of unitary construction and may be fabricated from a self-lubricating plastic material such as acetal resin, thus avoiding the need for a separate source of lubricant.

7 Claims, 7 Drawing Figures

LABEL REMOVAL DEVICE

FIELD OF THE INVENTION

The present invention relates generally to devices for separating adhesively connected material, and more specifically to a device for removing pressure sensitive labels from surfaces to which they are adhered.

BACKGROUND OF THE INVENTION

It is a known practice to remove self-adhesive labels, such as price labels, from packages to which they are adhered and to replace them with labels bearing a different, typically higher, price. Under inflationary economic conditions during which the price of an article increases several times while the article is on the shelf, a significant effort must be expended in removing old price labels prior to replacement with new ones.

Although various common implements such as knives and razor blades have been used to remove such labels from substrate surfaces, a specialized device for this purpose has been developed and is the subject of the commonly owned U.S. Pat. No. 4,128,452. The device disclosed therein basically resembles a thin chisel in a lubricating sheath. The device includes a blade having a generally rectangular frontal portion, with an upper surface, a planar lower surface, and a surface angularly inclined from the upper surface to the lower surface, thus defining straight side-cutting edges and a straight leading edge. Additionally, a handle is set at an elevation above the flat lower surface to allow the user to hold the device without interfering with the substrate surface. The device also includes a sheath having inner walls of absorbent, lubricant-impregnated material for applying a film of lubricant to the blade to prevent the label from sticking to it.

While this device is highly effective for its stated use, it has some disadvantages. The blade, typically consisting of thin metal, requires the application of lubricant, so that the adhesive from the label to be peeled does not stick to the metal surfaces. It will be readily appreciated that the sheath and the implement may become separated. Moreover, the lubricant supply may diminish and its replacement may be impractical or inconvenient for the user. The use of lubricant is particularly critical, since when the supply of lubricant dwindles, the label tends to stick to the upper surface of the thin, flat blade, thus impeding further operation. Additionally, the prior art device presents a danger to the user, since it is characterized by straight sharp edges. Additionally, if the blade is not held absolutely flat with respect to the substrate surface, it may mar said surface.

SUMMARY OF THE INVENTION

The present invention provides a device for removing self-adhesive labels without damaging the substrate. The device is a generally elongate tool having a blade portion and a handle portion. The blade has a first normally downwardly facing flat surface for contacting the substrate and a second opposed normally upwardly facing generally convex surface. The first and second surfaces come together along a generally curved periphery at a small angle to define a sharp edge. The device also includes a handle attached to the blade and having a gripping portion displaced upwardly from the flat surface of the blade to permit a user to hold the device with the flat blade surface against a flat substrate surface. The handle is preferably inclined upwardly away from the blade as well.

The preferred configuration of the blade's periphery is such that it includes a curved leading edge characterized by a first curvature, first and second longitudinally extending portions characterized by a second curvature, and first and second transitional regions characterized by a third curvature that is greater than the first and second curvatures.

In use, the device is held with the flat surface of the blade against the substrate. The blade is wedged between the label and the substrate to remove the label. Since there are transversely and longitudinally extending edges, any desired angle of attack may be employed, depending on clearances and user preference. It is sometimes convenient to use the device with a forward movement (like a chisel) and sometimes preferable to use a sideways movement or a movement toward the user.

The convex upper surface of the blade has several desirable characteristics. In particular, as the curved periphery is interposed between the self-adhesive label and the substrate, the area of contact between the self-adhesive portion of the label and the upper surface is minimized due to the curvature of the upper surface. Further, as the label is peeled from the substrate, it tends to curl away from the blade, further minimizing the area of contact with the curved surface of the blade. Thus, a surprisingly small amount of adhesive material accumulates on the upper surface of the blade.

The rounded periphery allows the blade to penetrate the region between the self-adhesive label and the substrate in a gradual manner, thereby reducing the likelihood of tearing of the label, or delamination of the substrate if it is of a paper-like material. Moreover, the rounded periphery provides a sharp edge that is generally devoid of pointed corners potentially dangerous to the user or the substrate.

The blade and handle are preferably of unitary construction and may be fabricated from a slippery-surfaced plastic material such as acetal resin, thus avoiding the need for a separate source of lubricant. The plastic edge is completely suitable for use with labels but is generally less likely than a metal edge to cut either the user or the substrate. The slippery-surfaced plastic construction makes it a simple matter to remove any accumulated gummy material, as, for example, by rubbing a thumb or finger over the upper or lower surface of the blade.

For a further understanding of the nature and advantages of the present invention, reference should be made to the remaining portions of the specification and to the attached drawings.

DETAILED DESCRIPTION OF THE INVENTION

Figure 1:
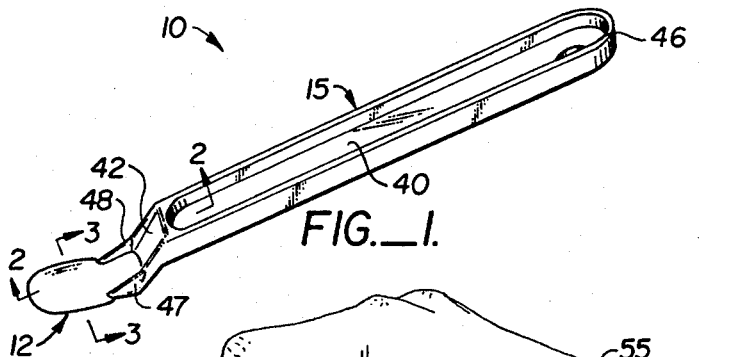
FIG. 1 is a perspective view of a label-peeling device according to the present invention.
Figure 3:
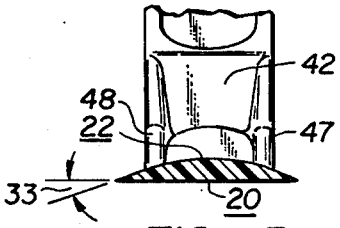
FIG. 3 is a transverse sectional view taken along line 3—3 of FIG. 1.
Figure 4:
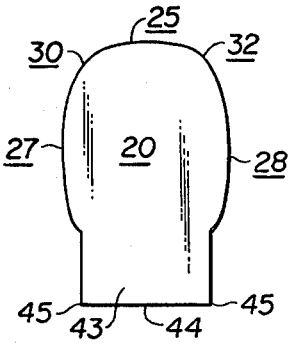
FIG. 4 is a bottom plan view of the blade.

FIG. 1 shows a label-peeling device 10 that is useful for separating self-adhesive materials such as paper labels or cellophane tape from a substrate to which such material is adhered. Device 10 is generally of elongate configuration having a blade 12 proximate a first end thereof and a handle 15 mechanically coupled to blade 12 and extending longitudinally away therefrom. The configuration of blade 12 is best seen with additional reference to FIGS. 2, 3, and 4. Blade 12 has a generally plano-convex configuration defined by a normally lower flat surface 20 and an upper generally convex surface 22. Surfaces 20 and 22 come together in the plane of surface 20 along a generally curved periphery which, in the preferred embodiment, comprises a transversely extending curved leading portion 25, opposed longitudinally extending curved side portions 27 and 28, and transitional curved corner portions 30 and 32. Transitional portions 30 and 32 are typically of greater curvature than portions 25, 27, and 28. For example, for a blade having a maximum transverse dimension of approximately 0.8 inches, typical radii of curvature are 1 inch for leading edge portion 25, 1.25 inches for side edge portions 27 and 28, and 0.125 inches for transitional portions 30 and 32.

Surfaces 20 and 22 come together along the periphery at a relatively small angle, generally designated 33, to define a sharp edge. Angle 33 is typically in the range 15° to 30°, with 23° being preferred. Due to the compound curvature of the periphery, angle 33 is not necessarily absolutely uniform at all points along the periphery, but is generally within the stated range.

Figure 2:
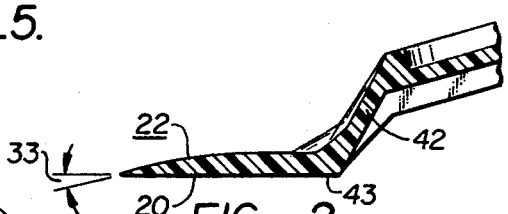
FIG. 2 is a fragmentary longitudinal sectional view taken along line 2—2 of FIG. 1.

Handle 15 includes a gripping portion 40 and an angled portion 42 interposed between gripping portion 40 and blade 12. Angled handle portion 42 displaces handle gripping portion 40 above the plane of lower surface 20, so that clearance is provided for a hand that would grip handle 15. Angled handle portion 42 joins blade 12 at a trailing portion 43 thereof, to define a straight trailing edge 44 and rear corners 45. However, the rear corners are not characterized by sharp angles. For ease of use, as can be seen in FIG. 2, handle gripping portion 40 is preferably inclined with respect to the plane of flat blade surface 20 by an angle of approximately 15°. Handle gripping portion 40 preferably has a rounded end 46 remote from angled handle portion 42.

Device 10 is preferably of unitary construction and fabricated from a slippery-surfaced plastic material such as an acetal resin. A suitable plastic material is commercially available under the Dupont trademark "Delrin," or "Delrin 8020." Fabrication is typically by an injection-molding process, and a suitably sharp feathered edge for blade 12 is achieved by polishing the edges of the mold cavity that define upper blade surface 22 where it abuts the flat mold surface that defines lower blade surface 20. Handle gripping portion 40 may have any convenient shape, but an H-section is convenient, since it provides strength with a relatively small amount of material. Angled handle portion 42 is provided with longitudinally extending gussets 47 and 48 to provide strength in the region where handle 15 joins blade 12.

Figure 5:
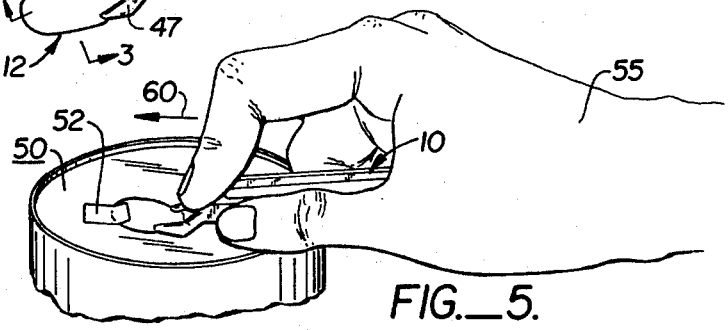
FIG. 5 is a perspective view showing a first mode of operation.
Figure 6:
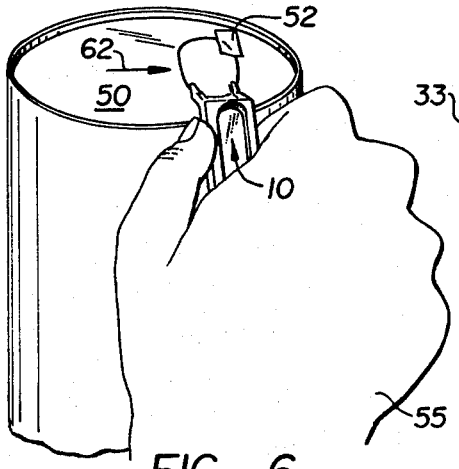
FIG. 6 is a perspective view showing a second mode of operation.
Figure 7:
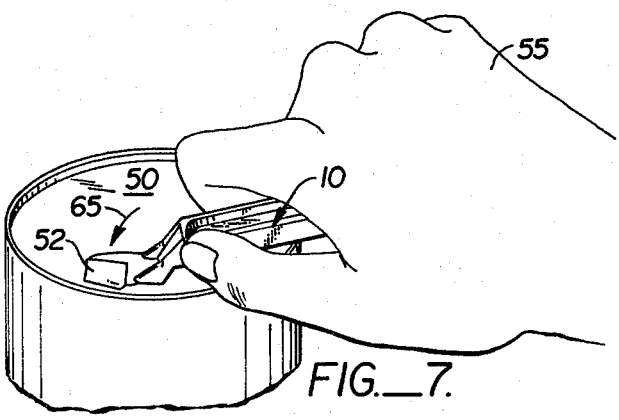
FIG. 7 is a perspective view showing a third mode of operation of the present invention.

FIGS. 5, 6, and 7 are perspective views showing different modes of operation of the present invention. In use, device 10 is gripped with a hand, and blade surface 20 is pressed flat against a substrate surface 50 to which a self-adhesive label 52 is adhered. Blade 12 is then slid under label 52, so that the peripheral edge cuts through the adhesive and separates label 52 from substrate surface 50.

It will be appreciated that the continuous and smooth-curved periphery allows a flexible line of attack. FIG. 5 shows a first mode of operation. Device 10 is gripped with a hand 55 in such a manner that an index finger generally overlies angled handle portion 42, while handle end 46 abuts the heel of hand 55. Device 10 is then pushed in a generally longitudinal direction away from the user as indicated by arrow 60.

FIG. 6 shows a second mode of operation in which a user holds device 10 with the fingers generally encircling handle gripping portion 40. Device 10 has its longitudinal axis extending generally away from the user, and separation of label 52 from substrate surface 50 is effected by a transverse motion of device 10 along a direction generally sideways with respect to the user, as indicated by arrow 62.

FIG. 7 shows yet a third mode of operation in which device 10 is gripped similarly to the manner in which it is gripped in FIG. 6; however, here the longitudinal axis extends transversely with respect to the user. Removal of label 52 is effected by a transverse movement of device 10 with respect to its own axis as device 10 is drawn toward the user, as indicated by arrow 65.

The existence of these (and presumably other) alternate modes of operation allows the device to be used very rapidly and conveniently under circumstances where clearances and the like do not permit a uniform mode of operation. For example, when a label is stuck to the top of a tin can near its peripheral rim, device 10 must be moved radially outward from the center of the can. However, where several cans are to have their labels removed, it is to be expected that some labels will be proximate the portion of the rim nearest the user, while others will be proximate the portion of the rim farthest from, or to one side of, the user. Rather than either rotating individual cans or changing position, the user need merely operate device 10 according to one of the modes described above. Additionally, individual preferences and circumstances will tend to dictate certain modes. For example, the mode illustrated in FIG. 5 is especially well-suited to a situation where the adhesive is very stubborn, since the user may apply extra localized pressure on upper surface 22 of blade 12 with the index finger. On the other hand, the hand positions shown in FIGS. 6 and 7 are likely to be somewhat more relaxing for long-term continuous use.

Regardless of which mode of operation is actually employed, the configuration of blade 12 results in generally the same result. Due to the curvature of the blade edge, a gradual incursion of blade 12 between label 52 and substrate surface 50 occurs, thereby minimizing the likelihood of tearing of the label or the possible delamination of a paper substrate. The convex-curved configuration of the upper blade surface 22 ensures that the area of contact between the adhesive surface of the label and the blade is minimized. Additionally, the label tends to curl away from the blade to even further minimize contact. In the event that gummy residue from the labels accumulates on blade surface 22, the user need merely wipe it off with his thumb.

In summary, it can be seen that the present invention provides a surprisingly simple and effective label-removing device that is safe for the user and the substrate surface and, when fabricated from slippery-surfaced plastic, does not require an auxiliary sheath or other apparatus. While the above provides a full and complete disclosure of the preferred embodiments of the invention, various modifications, alternate constructions, and equivalents may be employed without departing from the true spirit and scope of the invention. For example, the periphery of blade 12 could be circular or it could incorporate relatively straight portions, as long as it is continuous and smooth. Therefore, the above description and illustrations should not be construed as limiting the scope of the invention, which is defined by the appended claims.

What is claimed is:

1. A device for separating adhesively connected material comprising:

a blade having a first normally downwardly facing flat surface and a second opposed normally upwardly facing generally convex curved surface, said first and second surfaces coming together at a generally curved periphery, which periphery is continuous and smooth over leading and side portions thereof, said first and second surfaces coming together along said periphery at a small angle to define a sharp edge; and, a handle mechanically coupled to said blade and having a gripping portion displaced upwardly from said flat first surface to permit a user to grip said handle gripping portion with a hand without having the hand extend downwardly beyond the plane of said flat surface.

2. The invention of claim 1 wherein said blade and said handle are of unitary construction and are fabricated from a slippery-surfaced plastic material.

3. The invention of claim 2 wherein said plastic material is an acetal resin.

4. The invention of claim 1 wherein said gripping portion of said handle is upwardly inclined away from said blade.

5. The invention of claim 1 wherein said blade periphery includes a transversely extending portion characterized by a first curvature, first and second longitudinally extending portions characterized by a second curvature, and first and second transitional regions characterized by a third curvature that is greater than said first and second curvatures.

6. The invention of claim 1 wherein said angle between said first and second surfaces is within the range 15° to 30° at all points on said periphery.

7. A device for separating adhesively connected material comprising:

a blade having a first normally downwardly facing flat surface and a second opposed normally upwardly facing generally convex surface, said first and second surfaces coming together at a generally curved periphery, which periphery is continuous and smooth over leading and side portions and includes a transversely extending portion characterized by a first curvature, first and second longitudinally extending portions characterized by a second curvature, and first and second transitional regions characterized by a third curvature that is greater than said first and second curvatures, said first and second surfaces coming together along said periphery at an angle within the range 15° to 30° at all points on said periphery to define a sharp edge; and, a handle mechanically coupled to said blade, said handle having a gripping portion displaced upwardly from said flat first surface and upwardly inclined therefrom to permit a user to grip said handle gripping portion with a hand without having the hand extend downwardly beyond the plane of said flat surface;

said blade and said handle being of unitary construction and fabricated from a slippery-surfaced plastic material.

* * * * *